US009676011B2

(12) United States Patent
Pahlman

(10) Patent No.: US 9,676,011 B2
(45) Date of Patent: Jun. 13, 2017

(54) CONTROL TECHNIQUE FOR MULTISTEP WASHING PROCESS USING A PLURALITY OF CHEMICALS

(75) Inventor: Tuomas Pahlman, Tampere (FI)

(73) Assignee: Sealed Air Corporation (US), Charlotte, NC (US)

( * ) Notice: Subject to any disclaimer, the term of this patent is extended or adjusted under 35 U.S.C. 154(b) by 876 days.

(21) Appl. No.: 13/220,190

(22) Filed: Aug. 29, 2011

(65) Prior Publication Data

US 2013/0048024 A1 Feb. 28, 2013

(51) Int. Cl.

| | |
|---|---|
| ***B08B 7/04*** | (2006.01) |
| ***D06F 39/02*** | (2006.01) |
| ***B08B 3/00*** | (2006.01) |
| ***A47L 15/00*** | (2006.01) |
| ***A47L 15/44*** | (2006.01) |
| ***D06F 39/00*** | (2006.01) |
| ***D06F 39/08*** | (2006.01) |

(52) U.S. Cl.

CPC ..... *B08B 7/04* (2013.01); *A47L 15/0055* (2013.01); *A47L 15/449* (2013.01); *A47L 15/4418* (2013.01); *B08B 3/00* (2013.01); *D06F 39/004* (2013.01); *D06F 39/006* (2013.01); *D06F 39/022* (2013.01); *D06F 39/088* (2013.01)

(58) Field of Classification Search

CPC .... B08B 3/00; B08B 7/00; B08B 7/04; A47L 15/005; A47L 15/4418; D06F 39/004; D06F 39/006; D06F 39/022; D06F 39/088

USPC ..... 134/10, 18, 25.2, 42; 68/12.18, 17 R

See application file for complete search history.

(56) References Cited

U.S. PATENT DOCUMENTS

| | | | | |
|---|---|---|---|---|
| 6,453,927 | B1 * | 9/2002 | Peterson et al. | 137/3 |
| 2003/0116177 | A1 | 6/2003 | Appel et al. | |
| 2006/0107705 | A1 | 5/2006 | Hsu et al. | |

FOREIGN PATENT DOCUMENTS

| | | | |
|---|---|---|---|
| DE | 100 39 408 | A1 | 12/2001 |
| WO | WO 2006/073885 | A2 | 7/2006 |
| WO | WO 2009/033016 | A2 | 3/2009 |

* cited by examiner

*Primary Examiner* — Saeed T Chaudhry
(74) *Attorney, Agent, or Firm* — Barnwell Whaley Patterson & Helms, LLC

(57) ABSTRACT

Equipment and method for a system implementing a multistep washing process, with a chemical container (110A-110D) for each chemical (111A-111D) and means for conveying one chemical at a time from the container through a feed channel (120) to a washing object (100) and from the washing object through a return channel (130) back to the container. First and second sensors (122, 132) monitor a first parameter set in the feed channel (120) and a second parameter set in the return channel (130), respectively. Both parameter sets include parameter(s) indicating the purity of the chemical. A control center (150) includes calculation means (153) arranged to determine the mutual uniformity of the first and second monitored parameter sets. Action time of the chemical is determined on the basis of the mutual uniformity of the first and second monitored parameter sets.

11 Claims, 5 Drawing Sheets

100
Process
120
130
Actuator valves
Sewer
123
Other quality analysis, e.g. conductivity measuring
131
Return pump
122
Measuring of parameters (e.g. absorbance)
Other quality analysis, e.g. flow measuring
133
132
113C
113B
113D
113A
111C
111B
111D
111A
Acid
110C
Base
110B
Dis-infection
110D
Rinsing agent
110A
112C
112B
112D
112A
Water
150
Control centre
152 memory
153 calculation
154 decision
151
I/O

CONTROL TECHNIQUE FOR MULTISTEP WASHING PROCESS USING A PLURALITY OF CHEMICALS

BACKGROUND OF THE INVENTION

The invention relates to a method and a system for measuring the quality of a multistep washing process using a plurality of chemicals and to measuring equipment for said system. In connection with this invention, the chemicals also include rinsing agents, such as water.

PCT publication WO 2006/073885 discloses a fluid treatment system for use with a multistep washing appliance. A controller controls solenoids, through which chemicals are dispensed into a washer. Publication WO 2006/073885 does not describe, however, on which basis the controller decides that one step is over and the next one starts.

A technique for proceeding from one step to another in a multistep washing process is to program in a controller an empirical duration for each washing step, after which a transition to a next step takes place. This operating principle applies, for instance, to household washing machines and dishwashers. In some cases a pre-programmed time may start when a condition for a washing step is fulfilled, for instance, the wash water is heated to a sufficiently high temperature.

A problem with this technique is how to rate optimally the durations of different steps in the multistep washing process. If the durations are too short, the wash result is poor, whereas excessively long wash times consume time and energy unnecessarily.

BRIEF DESCRIPTION OF THE INVENTION

The object of the invention is thus to provide a method and equipment implementing the method such that the above problem may be solved. The object of the invention is achieved by a method and equipment, which are defined in the attached independent claims. The dependent claims and this description disclose particular embodiments of the invention.

According to a first aspect of the invention, a method is performed for controlling a multistep washing process using a plurality of chemicals, in which method at least one chemical is pumped through a feed channel from a chemical container to a washing object and from the washing object through a return channel back to the chemical container. The method of the invention comprises:

- monitoring, during said pumping, a first parameter set in the feed channel and a second parameter set in the return channel, wherein both parameter sets include at least one parameter indicating directly or indirectly the purity of the chemical;
- determining the mutual uniformity of the first and the second parameter sets, and
- determining the action time of the chemical on the basis of the mutual uniformity of the first and the second monitored parameter sets.

The action time of a chemical refers to the time, when the chemical circulates in the process, i.e. the time in the course of which said chemical is pumped through the feed channel from the chemical container to the washing object and from the washing object through the return channel back to the chemical container. The effective action time of the chemical is the time within which the chemical has completed the washing. Thus, the action time of the chemical is divided into an effective action time and an extra securing time.

According to a second aspect of the invention there is implemented a control apparatus for controlling this method. According to a third aspect of the invention there is provided a system for implementing a multistep washing process, the system comprising the control apparatus in accordance with the second aspect of the invention.

According to an embodiment of the invention, there are implemented a real-time control apparatus and a control method for a multistep washing process. In the real-time control of the washing process, information on the mutual uniformity of the first and the second monitored parameter sets is utilized in the same instance of the washing process, where the monitoring takes place. In that case, in response to the fact that the determination of uniformity indicates the first and the second parameter sets to be similar within a predetermined threshold value, a transition is made to a next step in said multistep washing process.

An embodiment of this kind, based on real-time control of the washing process, is based on monitoring, both in the feed and in the return channels, a first and a second parameter set, respectively, which parameter sets include one or more parameters indicating directly or indirectly the purity of a chemical. The mutual uniformity of the parameter sets monitored in the feed and the return channels is determined. As long as the second parameter set monitored in the return channel differs sufficiently, i.e. for an amount of a predetermined threshold value, from the parameter set that is monitored in the feed channel, it is possible to infer that the chemical has a cleaning effect in the washing process. When the parameter sets are uniform within the predetermined threshold value, it is possible to infer that the chemical has no longer any cleaning effect and consequently it is possible to proceed to a next step in the washing process.

The real-time embodiment has an advantage, for instance, that time and/or energy is saved, which results from the fact that the duration of at least one washing step is adaptive. Adaptivity refers to the fact that the duration of at least one washing step is not programmed in a fixed manner, but the washing step is continued only to a point when the chemical no longer has any cleaning effect.

In all washing processes it is difficult, or even impossible, to implement the real-time feature, for instance, because of long pumping delays, whereby it will be necessary to start replacing a previous chemical with a next one before the first and the second parameters sets monitored in the feed channel and the return channel have attained sufficient uniformity. The invention may be applied to washing process of this kind through a non-real-time embodiment, where in a plurality of washing process instances there is determined a time for one or more washing process steps, during which time the first and the second parameter sets attain sufficient uniformity, whereby the chemical no longer has any cleaning effect. In this connection, the washing process instance refers to washing operations to be performed in the same or similar washing process at different times. Of these several washing process instances is selected a representative, worst case time, which may be, for instance, the longest time required for the first and the second parameter sets to attain sufficient uniformity in the course of said time. Time determination of this kind is carried out separately for each duration of washing step to be optimized. The durations determined in this manner may be utilized in manufacturing or adjusting the control apparatus of the washing process.

The invention is not limited to any particular environment, and the washing object may be, in practice, any closed or open space, where chemicals may be introduced from a chemical container via a feed channel and wherefrom chemicals may be returned to containers via a return channel. According to an illustrative example, the washing object may be manufacturing or processing appliances of food products, fermentation tanks, transport tanks etc.

According to an embodiment, in the washing process the first parameter set to be monitored in the feed channel and the second parameter set to be monitored in the return channel include absorbance of electromagnetic radiation at least at one wavelength, the wavelength being within the range of 230 to 1100 nm. Absorbance of electromagnetic radiation, i.e. ability of a chemical to absorb light, is a good indicator of the purity of a chemical. To put it more precisely, absorbance is a good indicator of impurity, whereby a parameter P indicating the purity of a chemical may be a descending function of absorbance, for instance, P=1/absorbance or P=1−normalized absorbance.

According to a more advanced embodiment, absorbance is monitored at several discrete wavelengths, which are within the range of 230 to 1100 nm, or alternatively, at one or more wavelength ranges, whose lower and upper limits are within 230 to 1100 nm. By monitoring the absorbance at several discrete wavelengths or the total absorbance at all the wavelengths of a given wavelength range it is possible to indicate presence of a plurality of impurity factors in the feed and the return channels, whereby the difference in the corresponding parameter sets indicates at several different wavelengths that the chemical still has a cleaning effect in the washing process.

According to an embodiment, the monitoring is not limited only to the uniformity of the parameter sets monitored in the feed and the return channels, but there is also generated a signal indicating exhaustion of each chemical used, if the absorbance measured in the feed channel exceeds a predetermined threshold value.

According to a second embodiment, the monitoring is not limited to the measuring of absorbance, but said parameter sets may also include one or more other parameters, such as electrical conductivity, temperature, pH and/or flow rate. Monitoring of these parameters, especially if implemented in just one channel, indicates mainly the quality of a chemical to be used, but not for how long the chemical will have a cleaning effect.

The invention comprises the feature that a parameter indicating the purity of at least one chemical is monitored both in the feed channel and in the return channel, and when the parameters monitored in those channels are sufficiently uniform, i.e. sufficiently close to one another, it is possible to infer that the chemical has no longer any cleaning effect in the washing process. In order to determine the uniformity of the monitored parameters it is possible to use, in practice, any mathematical function or operator, whose arguments include said parameters monitored in the feed channel and the return channel and the value of which function or operator approaches a predetermined value, when the parameters monitored in different channels approach one another. Hereafter, the term function will also cover mathematical operators, because the difference between a function and an operator appears only in notation, and any operator placed between the parameters may also be written as a function preceding the parameters. A well-known operator is the subtraction operator, i.e. the minus sign, which may also be expressed as a difference function as follows:

$$P_{return}-P_{feed}=\text{DIFFERENCE}(P_{return},P_{feed}).$$

$P_{return}$ and $P_{feed}$ represent here parameters monitored in the return and the feed channels, respectively, the parameters advantageously including absorbance of electromagnetic radiation at one or more wavelengths or wavelength range from 230 to 1100 nm. As is known, the difference function approaches zero, when its arguments approach one another. Another known function is the ratio of two monitored parameters, i.e. the quotient that approaches zero, when its arguments approach one another. It is conceivable, of course, that sensors monitoring the parameters are not identical, but that one produces an x-fold reading over another sensor. In that case, when the actual physical quantities in the feed and the return channels approach one another, the ratio of the output signals of the corresponding sensors approaches the value x or 1/x. It is also conceivable that the sensors monitoring the parameters, or the sensor output signal processing logics are, for instance, saturable or nonlinear for some other reason, whereby, instead of the actual value of absorbance, the parameters to be monitored could be nonlinear functions of absorbance.

Determination of the uniformity of the monitored parameters may be implemented by electronic circuits, data processing equipment executing a sequential program, learning logics, such as artificial neural networks, etc.

BRIEF DESCRIPTION OF THE DRAWINGS

In the following the invention will be described in greater detail in connection with preferred embodiments, with reference to the attached drawings, in which.

DETAILED DESCRIPTION OF THE INVENTION

Figure 1:
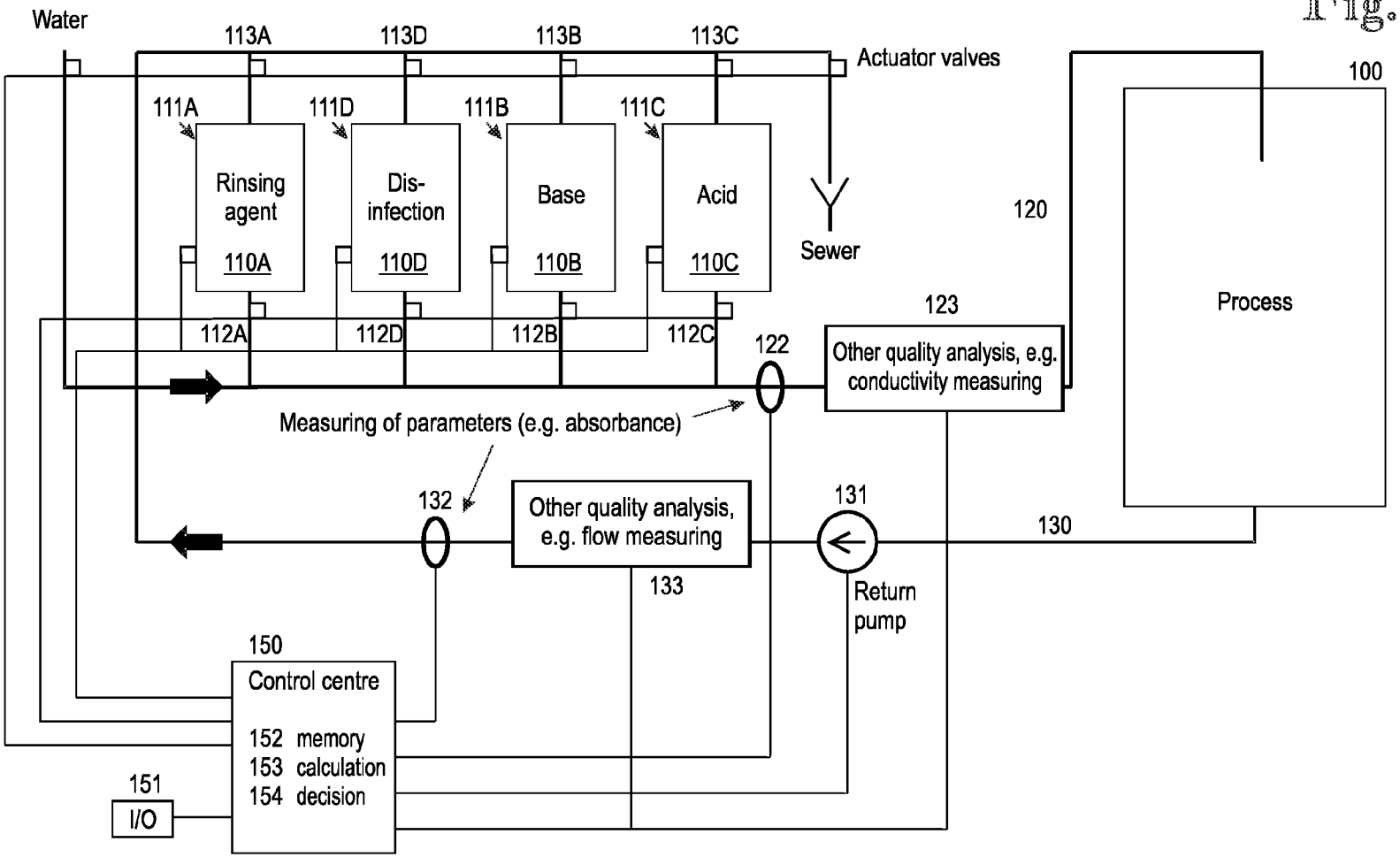
FIG. 1 is a diagram illustrating, by way of example, an arrangement for implementing a multistep washing process.

FIG. 1 is a diagram illustrating, by way of example, an arrangement for implementing a multistep washing process. The arrangement shown in FIG. 1 relates to a real-time implementation of the invention, in which a control center determines the durations of various steps of the washing process in the same washing process instance where monitoring is carried out. Modifications required by a non-real-time implementation are described in connection with FIG. 5B.

Reference numeral 100 denotes a washing process generally. In the example of FIG. 1, the washing process is described to take place in one compact container, but this is just one non-restrictive example, and the washing process may also take place in spaces of another shape, which may be decentralized, or open in some directions, such as car wash machines.

Reference numerals 110A, 110B, 110C and 110D indicate generally chemicals involved in a multistep washing process, of which chemicals at least some have a washing effect. Because the object of the invention is to determine an optimal action time, it is not necessary to make a distinction between washing and rinsing chemicals, and in connection with the invention, rinsing agents, such as water and disinfectants, are also included in the chemicals.

Reference numerals 111A, 111B, 111C and 111D indicate corresponding chemical containers. The chemicals may thus include also rinsing, disinfecting and/or protective agents, which have no actual washing effect. Reference numeral 120 indicates a feed channel in the washing process, through which the chemicals 110A to 110D are introduced into the washing process 100. Introduction of the chemicals may take place by using any known technique, such as pumping or gravity conveyance. In accordance with an embodiment, pressurized gas is conveyed into containers 111A to 111D of chemicals 110A to 110D, which makes one chemical at a time of chemicals 110A to 110D enter into the feed channel 120, when a remote-controlled valve 112A to 112D, for instance a magnetic valve, corresponding to the chemical container, is opened. The chemical is returned via a return channel 130 to container 111A to 111D of the corresponding chemical 110A to 110D, when a corresponding, second remote-controlled valve 113A to 113D is opened at the same time. In the arrangement of FIG. 1, the return of chemicals from the washing process 100 via the return channel 130 to the containers 111A to 111D takes place by means of a return pump 131, but other arrangements are also possible, as was stated in connection with the feed channel.

Reference numerals 122 and 132 indicate sensors or sensor sets associated with feed and return channels 120, 130, respectively, the sensors measuring in corresponding channels 120, 130 at least one parameter that indicates directly or indirectly the purity of the chemical. In this connection there is no need to make a sharp distinction between directly or indirectly indicating parameters, but the intention is to describe that the purity of the chemical may also be indicated indirectly. For instance, a quantity representing the purity—or more precisely, impurity—of the chemical may be a concentration of foreign substances. It is difficult, or at least slow and complicated, to measure directly a concentration in a real-time process, and consequently it is advantageous to indicate the concentration indirectly through absorbance. In case it were desirable to find out the concentration of impurities in the chemical as an absolute quantity, it would be possible to find out experimentally the dependence between the absorbance and the concentration of impurities. Dependence between direct and indirect indications of impurity would be different for different impurities and chemicals, however. This information may be utilized in deciding which wavelengths or wavelength ranges the sensors 122, 132 will monitor. An illustrative, but non-restrictive example is to indicate milk as impurity, for which the wavelength range of 660 to 880 nm is particularly effective.

Definition of dependence between direct and indirect indication is not necessary, however, at the stage when the equipment of the invention is in use, because, in accordance with the invention, it is the uniformity of the parameters indicating impurity between the feed channel 120 and the return channel 130 that is monitored, and when the parameters are uniform with a sufficient accuracy, it is concluded that the chemical used does not detach any longer impurities from the washing process and it is possible to proceed to a next step.

Reference numerals 123 and 133 indicate other quality analysis sensors, if any, mounted in the feed and return channels, respectively. In connection with this application another quality analysis of this kind refers to an analysis by which the quality of a chemical is analysed without making a comparison between the feed channel and the return channel. In FIG. 1, these quality analysis sensors are represented, by way of example, by a conductivity sensor 123 and a flow measuring sensor 133.

Reference numeral 150 denotes a control center that receives at least parameter data indicating the impurity of the chemical in the feed and return channels 120, 130 from the respective sensors 122 and 132. In addition to that, the control center may also receive other measurement data to be used in the quality analysis, which data may include, by way of example, temperature, electrical conductivity, pH value, liquid flow rate, or the like. The control center 150 includes, or is provided with an input/output device (I/O) indicated by reference numeral 151, through which the control center receives commands from the user and gives the user information on the state of the process. In addition, the control center includes a memory 151 indicated by reference numeral 152. In case the control center is implemented as a programmed data processing configuration, its control program may be stored in the memory 152. In FIG. 1, this control program consists of a calculation routine 153, which determines the quality of each particular chemical on the basis of the measurement data produced by the sensors, and a decision routine 154, which makes a decision on a transition to a next washing step, when the parameters measured in the feed and the return channels are sufficiently uniform.

In addition, in the memory 152 there are stored parameters which are required by the washing process control and which may include, for instance, information on which actuator valve 112A to 112D and 113A to 113D and/or pump 131 is to be controlled in connection with each particular chemical. The parameters stored in the memory 152 may also include limit values for the quality analysis of the chemicals measured in the feed channel 120, a limit value defining the uniformity for each particular chemical and, optionally, sensor calibration data, if the sensors 122, 132 of the feed and the return channels are not sufficiently identical with one another. In addition, the parameters stored in the memory 152 may also include information on the type of parameter the feed and return channel sensors 122, 132 monitor for each particular chemical. In an exemplary embodiment, in which the parameters to be monitored include absorbance, the parameters stored in the memory 152 may include information on which wavelength or wavelengths the monitoring is to be performed for each particular chemical. On the basis of this information the control center 150 may either set the sensors 122, 132 to monitor the selected parameter, such as absorbance, at the selected wavelength, or alternatively, the control center 150 may select from the data produced by the sensors 122, 132, the portion which best indicates the washing effect of each particular chemical used.

Figure 2:
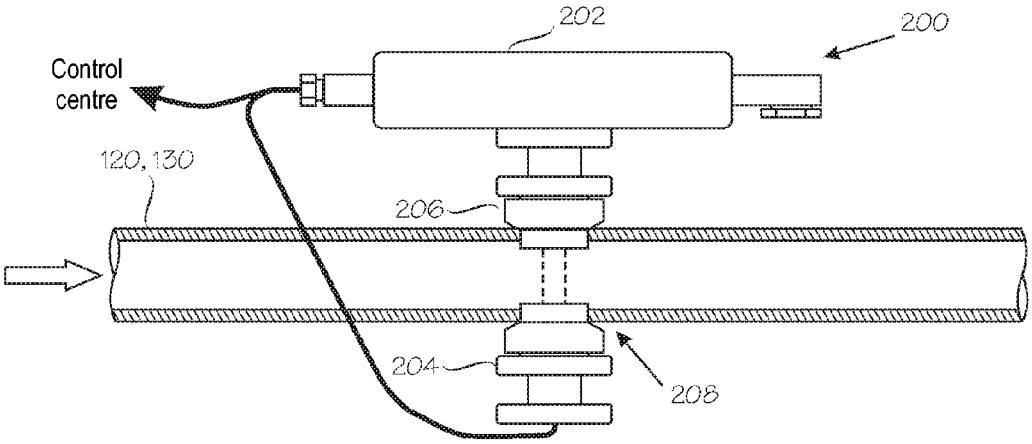
FIG. 2 is a schematic view of a sensor measuring absorbance.

FIG. 2 is a schematic view of a sensor 200 measuring absorbance. Absorbance is a good, but non-restrictive, example of a parameter indicating impurity of a chemical, whereby the sensor 200 is a non-restrictive example of sensors 122, 132 monitoring the feed and the return channels 120, 130 of FIG. 1. The sensor 200 includes a connection part 202, through which the sensor is connected to the control center 150. In addition, the sensor 202 includes a source 204 and a receiver 206 for transmitting electromagnetic radiation 208 across the chemical passing in the channel 120, 130. For the sake of simplicity, the electromagnetic radiation is here referred to as "light", even though in reality it is advantageous to measure absorbance, instead of or in addition to visible light, using infrared and/or ultraviolet range.

In order to indicate a plurality of different impurities it is advantageous that the sensor 200 or sensor set is arranged to measure absorbance at several distinct wavelengths or wavelength ranges. This may be implemented by using a plurality of sensors in connection with the channels 120, 130, of which sensors each one measures absorbance at a different wavelength. Alternatively, it is possible to place in one sensor a broad-spectrum light source 204 or a plurality of light sources for different narrower wavelength ranges, and a plurality of separate light receivers 206, each of which being sensitive to a particular narrow wavelength range. According to yet another arrangement, the sensor 200 may comprise one receiver 208 covering a wide wavelength range and a plurality of light sources 204 for different, narrower wavelength ranges, and of the plurality of light sources 204 there is activated, in each washing process step, the light source or the light sources whereby the absorbance of wavelengths produced best indicates the impurities that are to be removed in each particular step of the washing process.

As illustrative, but non-restrictive, examples, the light source 204 may comprise one or more semiconductor lights (LED), an incandescent lamp, a gas-discharge lamp, a laser or a combination of these techniques. The light receiver may comprise one or more semiconductor sensors, whose active element may be made, for instance, of silica, cadmium sulphide or selenium. Alternatively, or in addition thereto, a photomultiplier tube, a charge-coupled device, may serve as the light receiver. Between the light source 204 and the light receiver 208 there may be one or more optical filters, which pass particularly the wavelengths that best indicate the expected impurities. According to an embodiment, the filter is electrically controllable by an external control signal, and consequently the control center 150 may change the wavelength or wavelengths at which the monitoring takes place by adjusting or changing the filter. An electrically controllable filter of this kind may be implemented, for instance, by a technique that is known from video projectors. Alternatively, the sensor 200 may include, for instance, a plate rotating about an axis and having a plurality of different filters for different wavelengths.

Figure 3:
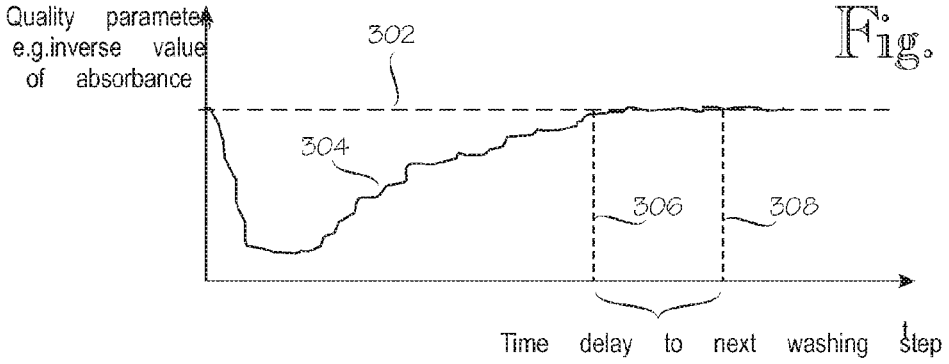
FIG. 3 is a diagram showing absorbance measured in a return channel as a function of time during one washing step.

FIG. 3 is a diagram showing a quality parameter measured in the return channel 130, for instance a descending function of absorbance, such as an inverse value, as a function of time during one washing step. Because, in accordance with the invention, the action time of a chemical is determined on the basis of the mutual uniformity of the first and the second monitored parameter sets, it is irrelevant how the parameter representing the quality of the chemical is deduced from the absorbance (or another parameter indicating impurity). In the diagram the x-axis represents time t and the y-axis represents a quality parameter of the chemical, such as an inverse value of absorbance. A broken line 302 indicates the quality parameter of the chemical in the feed channel 120, and naturally, the quality parameter of the chemical which is in the return channel, and which is indicated by reference numeral 304, cannot exceed this. When a washing step is started at a time instant t=0, it will take some time until the amount of impurities in the return channel reaches it maximum (the quality parameter 304 reaches its minimum). Thereafter, when the chemical (elements 110A to 110D of FIG. 1) acts in the washing process 100, soiled chemical is returned via the return channel 130 to the container of said chemical 111A to 111D, wherefrom purer chemical will be conveyed to the washing process 100.

Even though the quality parameter 302 of the chemical in the feed channel 120 seems constant in relation to time, it actually descends gradually with time, when impurities migrate from the washing process into the chemical container. Therefore it is advantageous to monitor the output signal of the feed channel sensor 122, i.e. the parameter indicating quality, as an absolute value and not only the uniformity of the sensors 122, 132. When the output signal 302 of the feed channel sensor 122 goes below a predetermined limit, said chemical batch may be deemed used up.

Reference numeral 306 shows schematically a time instant, when the control center 150 observes that the output signals of the sensors 122, 132 of the feed and return channels 120, 130 are uniform within the predetermined limits, and in that case the control center 150 may infer that the chemical then in use no longer has any cleaning effect, whereby under the control of the control center 150 the washing process proceeds to a next step. In case this uniformity was not measured, the control center would have to wait till the worst case time, determined by experience and denoted by reference numeral 308, before proceeding to a next washing step. The time between reference numerals 308 and 306 represents time saving provided by the technique of the invention.

Figure 4:
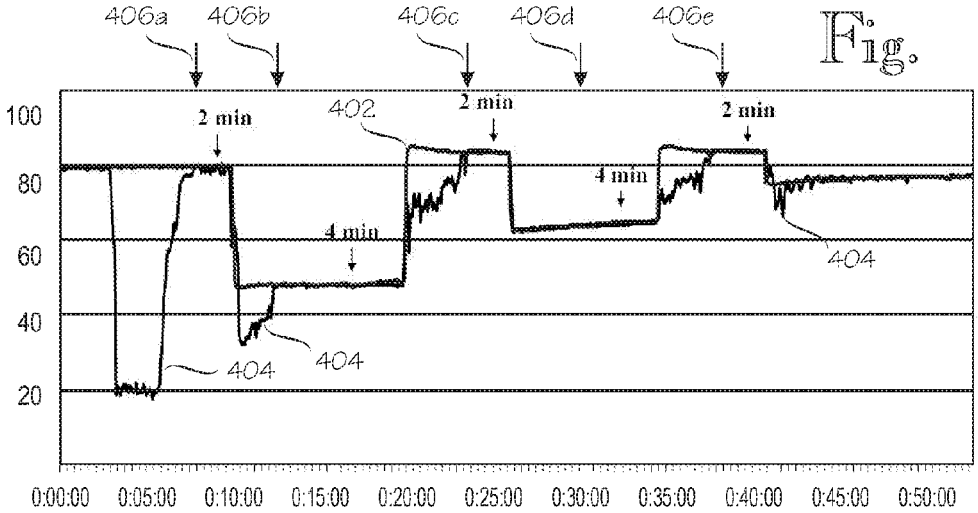
FIG. 4 shows measured absorbance as a function of time in an exemplary washing process.

FIG. 4 shows a measured quality parameter, for instance, an inverse value of absorbance, as a function of time in an exemplary washing process. In the case of FIG. 4, this exemplary washing process concerns washing of dairy reception pipelines. Curve 402 describes the purity of a chemical in the feed channel 120 and curve 404 in the return channel 130, respectively. In the case of FIG. 4, washing starts by pumping a pre-rinsing agent approximately at time instant t=3 min. Chemicals to be used after the pre-rinsing agent are a base (t=10 min), an intermediate rinsing agent (t=20 min), an acid (t=27 min) and a final rinsing agent (t=35 min). Reference numerals 406*a* to 406*e* indicate time instants, when the parameters indicating purity of the chemical, monitored in the feed channel 120 and the return channel 130, are uniform within a predetermined margin. Time delays 2 min, 4 min, etc., which follow reference numerals 406*a* to 406*e*, represent times when the chemical in the washing process instance of FIG. 4 no longer has any cleaning effect.

Figure 5A:
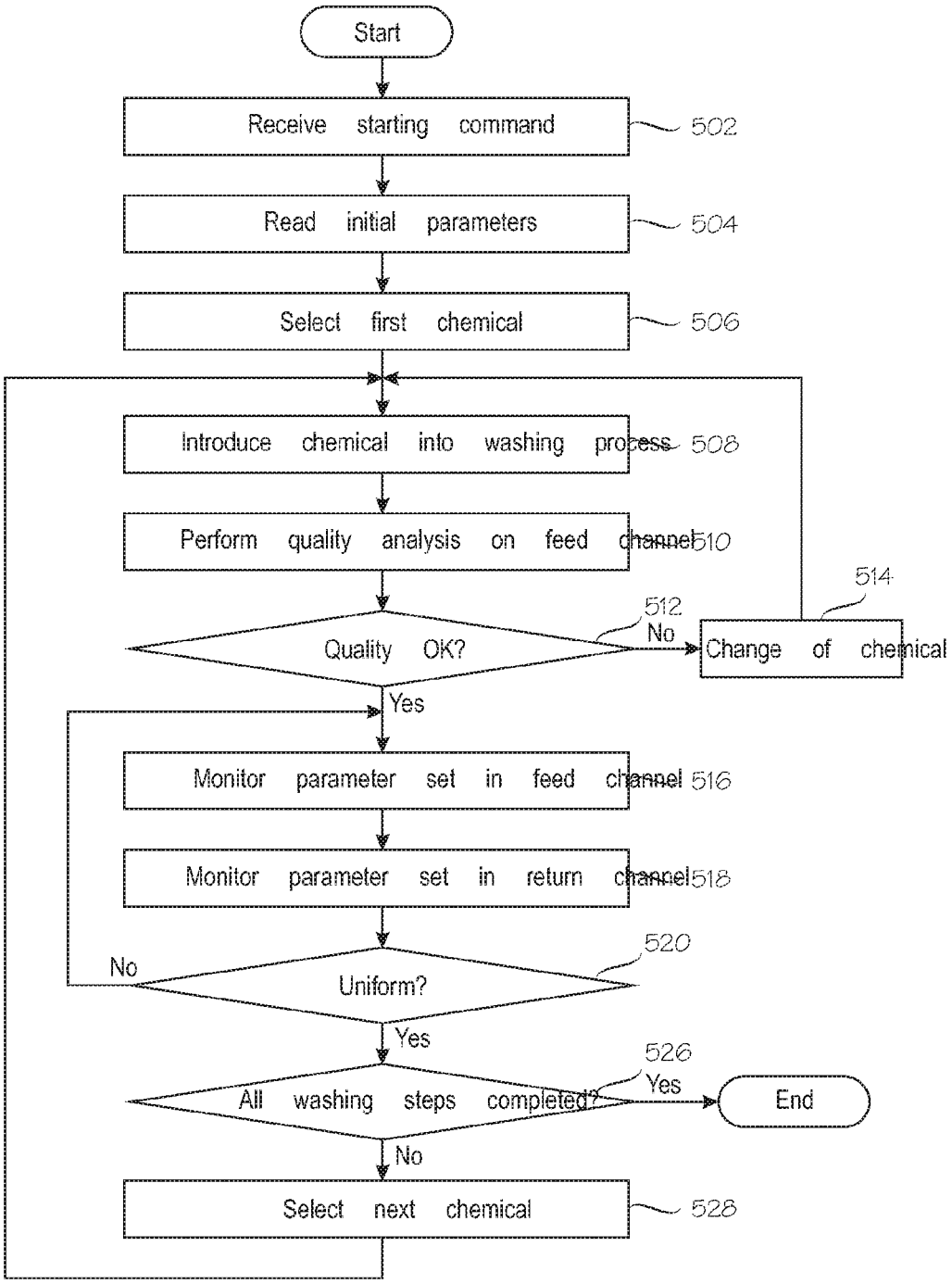
FIG. 5A is a flow chart illustrating implementation of a real-time embodiment of the invention, in which a control center is based on programmed data processing equipment.

In case the measuring in accordance with the invention is employed in real-time washing process control, these time delays may be eliminated by proceeding to a subsequent washing process step at time instants 406*a* to 406*e*. Whereas, if the measuring in accordance with the invention is employed in non-real-time washing process control, measuring equipment connected to, or separate from, the control center 150 may store in the memory time instants 406*a* to 406*e*, originating from a plurality of washing process instances, in relation to time when said washing step was started. The obtained times are durations in said washing process instances, during which the chemicals have a cleaning effect (within a predetermined margin). By repeating the measuring of FIG. 4 over a sufficient number of washing process instances, it is possible to determine a data set, which directly or indirectly indicates, with reasonable reliability, the worst case durations for each washing process step. FIG. 5A is a flowchart that illustrates the implementation of the real-time embodiment of the invention, in which the control center is based on a programmed data processing device. In step 502, the control center (element 150 of FIG. 1) receives through the input/output device 151*a* starting command including an identifier of a selected washing process. In step 504, on the basis of the washing process identifier, the control center reads starting parameters from the memory 152. These parameters have been described in connection with FIG. 1. The parameter reading step 504 has been presented as one discrete step, even though persons skilled in the art understand that the reading of parameters may also take place distributed in time, when each particular parameter is needed. In step 506, the control center selects a first chemical 110A to 110D, and on the basis of this information, selects the actuator valves 112A to 112D; 113A to 113D and/or the pump 131 to be activated. In step 508, the control center introduces the first chemical into the washing process 100 by activating the corresponding actuator valves and/or the pump. In step 510, which is not, however, any relevant step to the present invention, the control center reads the readings of quality analysis sensors 123, 133 and decides in step 512 whether the quality of the chemical is sufficient. If not, the process proceeds to step 514, in which the control center notifies the user that the chemical is to be changed, whereafter the process returns to step 508. Steps 516 to 520 relate to the technique of the invention, in which corresponding parameters are measured in the feed and return channels 120, 130, until in step 520 it is stated on the basis of the uniformity of the parameters that said chemical no longer has any cleaning effect in the washing process. Then, the process proceeds to step 526, in which it is examined whether all washing steps are completed. In the affirmative, the process is terminated and in other cases a next chemical is selected in step 528 and the process returns to step 508.

Figure 5B:
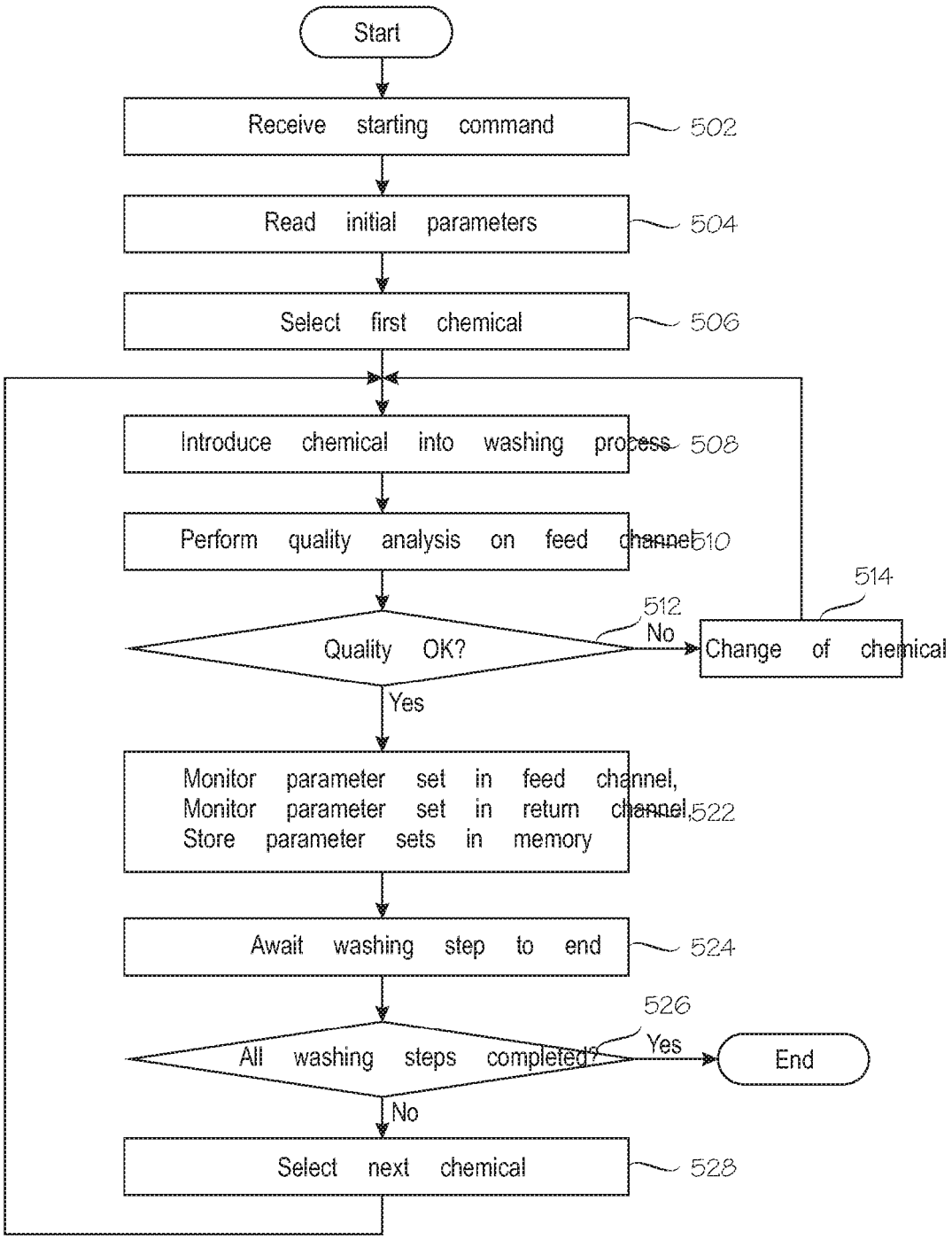
FIG. 5B is a flow chart corresponding to FIG. 5A for a non-real-time embodiment of the invention.

FIG. 5B is a flow chart corresponding to that of FIG. 5A for a non-real-time embodiment of the invention. The flowchart of FIG. 5B differs from the flow chart of FIG. 5A in that after step 512 in the feed channel and the return channel there are monitored parameter sets that are stored in the memory for subsequent analysis in step 522. In step 524 it is awaited that the predetermined duration of the washing step concerned ends. Steps 526 and 528 are performed as described in connection with FIG. 5A. The process of FIG. 5B is performed during a plurality of washing process instances, whereby results of monitoring are stored in the memory. On the basis of the stored monitoring results it is possible, for instance, to search for the worst case durations for each washing process step, i.e. the longest time delays required that the parameter sets monitored in the feed and the return channels have become uniform within a predetermined margin. This analysis was explained in connection with FIG. 4. The times determined in this manner may be set or programmed in the control center 150 for subsequent instances of the same or similar washing process.

Figure 6:
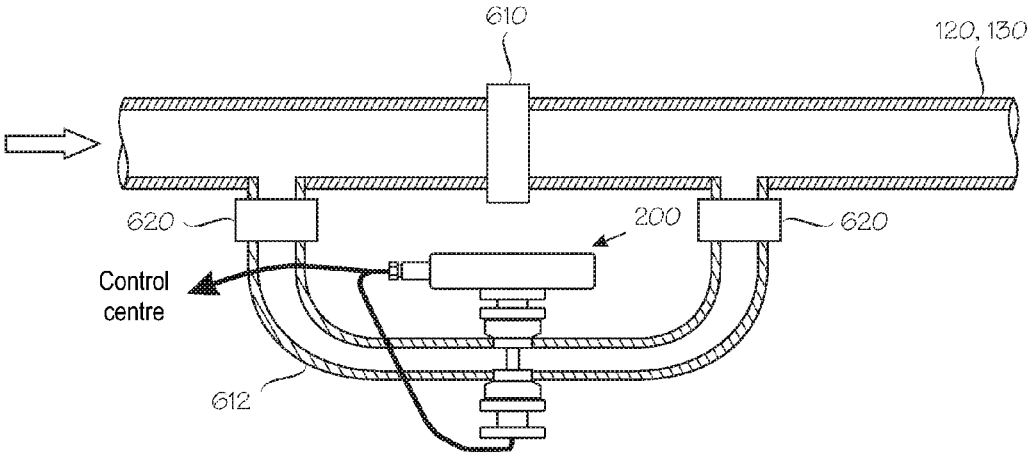
FIG. 6 shows a preferred placement of a sensor in connection with a bypass pipe.

FIG. 6 shows a preferred placement of a sensor 200 in connection with a bypass pipe. Some preferred implementations of the sensor 200 have already been described in connection with FIG. 2. A remaining problem may be posed by the fact that air or other gas bubbles and/or foam in the feed channel 120 or in the return channel 130 of the washing process make it difficult to measure the absorbance. To solve this remaining problem it is preferable to implement the arrangement of FIG. 6, in which a bypass pipe 610 to which the sensor 200 is mounted, is placed below the feed channel 120 and/or the return channel 130. The basic idea of this embodiment is that rising gases and foam that are lighter than the washing chemical rise to the channel 120, 130 above the bypass pipe 610, and do not interfere with the measurement of absorbance. The solution may be further enhanced by remote-controlled valves 620, by means of which the flow of washing chemical in the bypass pipe 610 may be stopped for a period to allow the gases and/or the foam to move higher up at the sensor 200. With the controllable valve 630 it is possible to make sure that a sufficient amount of chemical is transferred to flow from the feed channel 120 or the return channel 130 to the bypass channel 610 when the valves 620 are open.

It is apparent to a person skilled in the art that as technology advances, the basic idea of the invention may be implemented in a variety of ways. Thus, the invention and the embodiments thereof are not limited to the above examples, but they may vary within the scope of the claims.

The invention claimed is:

1. A method for optimizing a multistep washing process using a plurality of chemicals, the method comprising the following steps for at least one chemical:

conveying a chemical through a feed channel from a chemical container to a washing object and from the washing object through a return channel back to the chemical container;

monitoring, during conveyance of said chemical, a first parameter set in the feed channel and monitoring a second parameter set in the return channel, wherein each parameter set includes at least one parameter indicating directly or indirectly the purity of the chemical;

determining the mutual uniformity of the first and the second monitored parameter sets when the first parameter set and the second parameter set are similar within a predetermined threshold value; and determining an action time of the chemical on the basis of the mutual uniformity of the first and the second parameter sets.

2. The method of claim 1, wherein the action time is determined in real time in the same washing process instance, in which said monitoring is carried out.

3. The method of claim 1, wherein the action time of the chemical is determined in non-real time by carrying out said monitoring in a plurality of washing process instances, and the action time determined thereon is used in one or more subsequent washing process instances.

4. The method of claim 1, wherein said parameter sets include absorbance of electromagnetic radiation or a quantity derived therefrom at least at one wavelength, the wavelength being within the range of 230 to 1100 nm.

5. The method of claim 4, wherein said parameter sets include absorbance of electromagnetic radiation or a quantity derived therefrom at a plurality of discrete wavelengths within the range of 230 to 1100 nm.

6. The method of claim 1, wherein said parameter sets include total absorbance of electromagnetic radiation or a quantity derived therefrom at least in one wavelength range whose upper and lower limits are between 230 and 1100 nm.

7. The method of claim 1, further comprising generating a signal indicating exhaustion of each particular chemical used if the absorbance measured in the feed channel exceeds a predetermined threshold value.

8. The method of claim 1, wherein said parameter sets also include at least one parameter, which is selected from a group consisting of electrical conductivity, temperature, pH and flow rate.

9. The method of claim 1, wherein the determination of the mutual uniformity of the first and the second monitored parameter sets comprises determination of the difference or ratio of said parameter sets.

10. The method of claim 1, wherein the determination of the mutual uniformity of the first and the second monitored parameter sets comprises the measuring of the first and/or the second monitored parameter sets correspondingly in a bypass pipe below the feed channel and/or the return channel.

11. The method of claim 10, wherein the chemical flow in the bypass pipe is temporarily interrupted for the duration of the measuring of the first and/or the second parameter sets for allowing gas bubbles to discharge.

* * * * *